US005625367A

United States Patent [19]

Unwin

[11] Patent Number: 5,625,367

[45] Date of Patent: Apr. 29, 1997

[54] VARIABLE CAPACITANCE ANTENNA FOR MULTIBAND RECEPTION AND TRANSMISSION

[76] Inventor: Art Unwin, Rte. 13 Box 9, Bloomington, Ill. 61704

[21] Appl. No.: 406,421

[22] Filed: Mar. 20, 1995

[51] Int. Cl.[6] ..... H01Q 9/00

[52] U.S. Cl. ..... 343/745; 343/722; 343/747; 343/749; 343/823; 343/878

[58] Field of Search ..... 343/747, 749, 343/745, 722, 742, 878, 823, 810, 814, 816, 820, 713

[56] References Cited

U.S. PATENT DOCUMENTS

| | | | |
|---|---|---|---|
| 2,422,458 | 6/1947 | Amy et al. | 250/33 |
| 2,476,469 | 7/1949 | Walker | 343/823 |
| 2,619,596 | 11/1952 | Kolster | 343/882 |
| 2,861,267 | 11/1958 | Arrasmith | 343/823 |
| 2,898,590 | 8/1959 | Pichitino | 343/722 |
| 2,976,532 | 3/1961 | Guest | 343/722 |
| 3,419,869 | 12/1968 | Altmayer | 343/703 |
| 3,618,105 | 11/1971 | Bruene | 343/747 |
| 4,128,840 | 12/1978 | Tucker | 343/722 X |
| 4,496,952 | 1/1985 | Newcomb | 343/722 |
| 4,584,587 | 4/1986 | Ireland | 343/745 |
| 4,620,194 | 10/1986 | Bel Moratalla | 343/745 X |
| 4,868,577 | 9/1989 | Wingard | 343/713 |
| 5,048,641 | 9/1991 | Holcomb et al. | 343/713 X |

OTHER PUBLICATIONS

Les Moxon, HF Antennas for All Locations, 122–43 (2d ed. 1993) no month.

Tony Preedy, Seven Antennas On One Tower, Radio Communication, Nov. 1994, Dec. 1994, and Jan. 1995.

*Primary Examiner*—Donald T. Hajec

*Assistant Examiner*—Tho Phan

[57] ABSTRACT

A variable capacitance antenna allows individual adjustment of linear resonators on a beam antenna. A linear resonator is associated with each dipole element on a common support boom. A variable capacitance is positioned inside the boom and created using an arrangement of two coaxial conductive tubes as capacitive plates. One of the conductive tubes may be axially moved by a motor using a remote drive control. The movement of one conductive tube relative to the other can vary the capacitance from 0 to 100 picofarads, for example. The variable capacitance antenna can be used for both horizontal and vertical signal polarization applications. Such a variable capacitance antenna can receive and transmit electromagnetic signals on multiple frequency bands and in between frequency bands with high gain, high directivity, high efficiency, and low wind loading.

9 Claims, 4 Drawing Sheets

VARIABLE CAPACITANCE ANTENNA FOR MULTIBAND RECEPTION AND TRANSMISSION

BACKGROUND OF THE INVENTION

1. Field of the Invention

This invention relates to antennas capable of both receiving and transmitting high frequency signals. More specifically, this invention relates to beam antennas having a support boom and at least one driver element. Also, this invention relates to antennas that are capable of operating on more than one frequency band using remote tuning. This invention would be particularly useful for amateur radio operators, because amateur radio operators frequently transmit and receive signals on several frequency bands.

2. Discussion of the Related Technology

Conventional beam antennas, such as a Yagi antenna, include at least one driver element tuned to resonate at a desired receive/transmit frequency band and positioned at right angles to a support boom. To increase the directivity of such an antenna, a parasitic reflector element, usually tuned to a frequency slightly higher than the driver resonant frequency, can be placed parallel to the driver element along the boom. For further increased directivity, one or more director elements, usually tuned to frequencies slightly lower than the driver resonant frequency, can be placed at various distances along the boom on the other side of the driver element and parallel to the driver element. The driver and other elements are electromagnetically coupled for maximum gain and directivity and are usually of approximately the same length. In these antennas, the driver and the other elements are basically dipoles which in combination are resonant for a particular frequency band.

Trapped dipole antennas, which are variations of the Yagi antenna, can accommodate up to three transmit/receive frequency bands. Trapped dipole antennas have elements of approximately the same length positioned on a common support boom similar to Yagi antennas. In addition, however, trapped dipole antennas have electrical circuits consisting of wound inductance and capacitance arrangements, commonly called traps, placed near the ends of each element to force each element to resonate at a desired frequency band. Wound inductances, however, have several drawbacks, including high loss and heat generation. Trapped dipole antennas are often used in the amateur radio field where a series of bands are available, because one antenna can be used for several selected frequency bands. In order to use all the frequencies available for amateur radio transmission, however, more than one trapped dipole antenna would be required to obtain maximum efficiency of the transmitted signal.

A theoretical variation on the trapped dipole antenna was described in Les Moxon, *HF Antennas for All Locations* 122–43 (2d ed. 1992). This variation is similar to the trapped dipole antenna, except that a non-wound inductance/capacitance circuit is placed at the center of each element instead of at the ends of each element. The advantage of this linear resonator variation is that the antenna is electrically two antennas side by side in what is commonly known as a "double Zepp" arrangement. An element of this design exhibits more gain than an element of the trapped dipole design. This antenna has a higher efficiency than a trapped dipole antenna in multi-element form, but it is difficult to construct without increasing weight wind load and using specialized components.

SUMMARY OF THE INVENTION

With the recent assignment of more bands for amateur radio use, the need for multiband antennas has increased. Multiband antennas are needed to transmit on more than one amateur radio frequency band, receive public short wave transmissions, and receive and transmit on frequencies between bands.

The variable capacitance antenna provides a beam antenna arrangement with multiband reception and transmission capabilities. In addition to multiband capabilities, the variable capacitance antenna provides fine multifrequency tuning capabilities. According to one embodiment, a variable capacitance arrangement associated with each antenna dipole element is installed inside the boom of an antenna. Adjusting the capacitance of each dipole element alters the gain, efficiency, and directivity of the antenna as a whole. The antenna capacitance may be remotely tuned to a selected frequency and the antenna remotely rotated to maximize gain and directivity and minimize surface area to reduce wind loading.

Adjusting the dimensions of the variable capacitance antenna makes it applicable for any frequency where resonant dipole elements can be used. Also, the variable capacitance antenna can be used to receive or transmit either horizontally polarized signals, such as amateur radio signals, or vertically polarized signals, such as commercial radio signals.

An advantage of this antenna is that it enables both the receiving and the transmitting of signals in a large number of frequency bands. Another advantage of this antenna is that it has minimal weight and wind load. Another advantage of this antenna is that it supplies high efficiency and high gain yet has a minimal number of "unused" elements. Yet another advantage of this antenna is that it is capable of remote tuning to maximize efficiency for each and every frequency within a frequency band or series of frequency bands. Yet another advantage of this antenna is that it provides tuning such that a desired frequency having a weak signal may be received clearly even if signals on nearby frequencies are strong. Yet another advantage of this antenna is that, by remotely tuning the antenna during broadcast of signals, it minimizes or removes interference with received television signals.

DETAILED DESCRIPTION OF THE PREFERRED EMBODIMENTS

Figure 1:
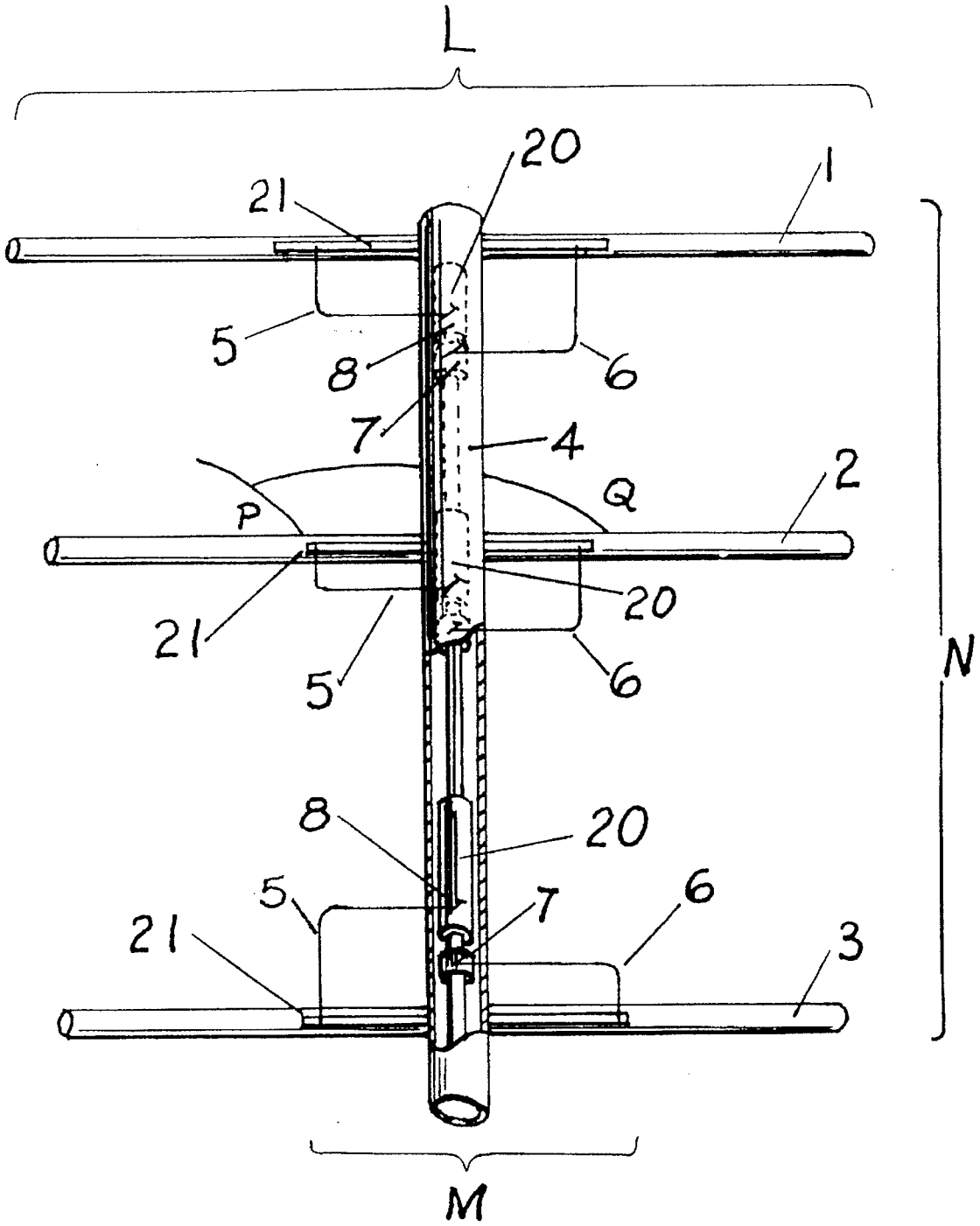
FIG. 1 shows a variable capacitance antenna having three dipole elements.

FIG. 1 shows an embodiment of the variable capacitance antenna having three dipole elements. The director element 1, driver element 2, and reflector element 3 are shown mounted on a common support boom 4. The variable capacitance antenna requires at least one driver element 2, however, there can be any number of directors including zero. In a preferred embodiment, the variable capacitance antenna contains one director element 1 and one reflector element 3, however, reflector elements may also be any number including zero.

Preferably, the three dipole elements are made of lightweight, electrically conductive material, such as aluminum alloy. Each of the dipole elements is approximately of length L, which preferably is approximately half the wavelength of the lowest frequency of interest. If the wavelength of the lowest frequency of interest is between 10 and 20 meters, then each dipole element length L would be approximately 10 meters, or 34 feet. Each element can have any diameter, however, a diameter of 1½ inches is suggested, with a tapered design for minimal wind load. Each dipole element should be electrically isolated from the boom if the support boom 4 is made of a conductive material.

To provide sufficient strength to support the dipole elements yet weigh a minimal amount, the support boom 4 is preferably a thin wall aluminum alloy tube with an outside diameter of 2 to 3 inches. A fiberglass or fiberglass and aluminum boom, however, is also acceptable. For a four element variable capacitance antenna designed to receive/transmit wavelengths of 10 to 20 meters, the boom length N is preferably 30 to 40 feet. For a two element antenna, the boom length N can be considerably shorter.

Connection of a transmission line to the variable capacitance antenna can be completed by the traditional delta match to the driver element 2 of the antenna at points P and Q shown in FIG. 1. The distance between points P and Q depends on the impedance of the transmission line, but it is expected to be five feet for a 34 foot driver element.

In the center portion of each element is a non-wound inductor/capacitor arrangement, commonly known as a linear resonator. A capacitor portion 20 of a linear resonator is inside the boom 4 and connected to a dipole element using conductive connecting wires 5, 6 such as wire braiding or tubing. A non-wound inductance portion 21 of the linear resonator may be formed at the center of each dipole element, between the connection points of connecting wires 5, 6 on the dipole element. In one embodiment, the inductor portion 21 of the linear resonator is of length M, which can be approximately 7 feet for a dipole element 34 feet long. The structure of an existing Yagi antenna can be modified to include a linear resonator with a variable capacitance portion inside the Yagi antenna boom. For a single element antenna, alternatively, capacitor portion 20 may be placed inside the element. Connecting screws 7, 8 should be spaced 4 inches or more away from inductor portion 21 of the linear resonator to prevent capacitive coupling between the connecting wires and their associated connecting screws 5, 7 and 6, 8 and the inductor portion 21. Connecting screws 7, 8 attach the connecting wires 5, 6 from the inductor portion 21 of a dipole element to the capacitor portion 20 inside the boom 4. Connecting screws 7, 8 are described in detail in FIG. 2.

Figure 2:
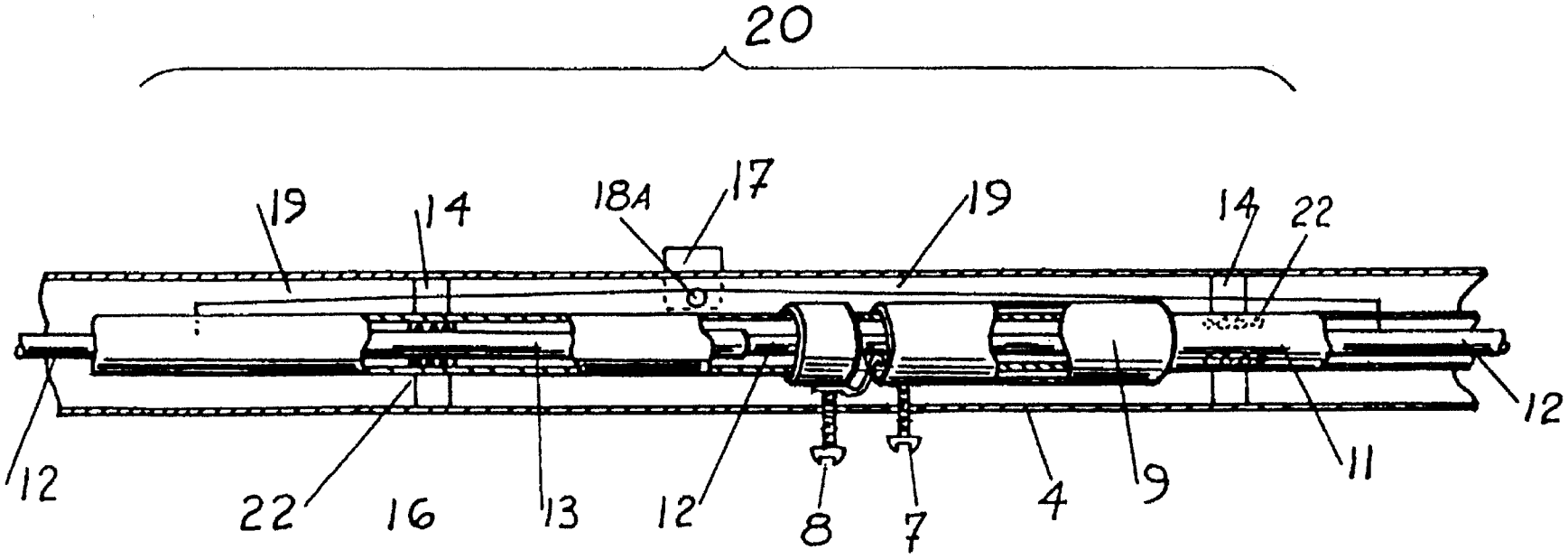
FIG. 2 shows a cross section of the support boom of a variable capacitance antenna detailing the structure of the variable capacitor portion and the remote tuning portion.

FIG. 2 shows a cross section of the boom of the variable capacitance antenna detailing the capacitor portion 20 of a linear resonator which includes conductive tubes 9, 13. Tubes 9, 13 are effectively the conductive plates of a variable coaxial cylinder capacitor. Advantageously, tubes 9, 13 are constructed of an aluminum alloy to provide a strong, lightweight, variable capacitor. Preferably, tube 13 has a length of 18 inches. Tube 13 may be slide fit onto a ¼ inch inner diameter nonconductive tube 12 approximately 20 inches shorter than the length of boom 4. Tube 13 can be secured to tube 12 by a detente 16 made by a center punch.

Figure 4:
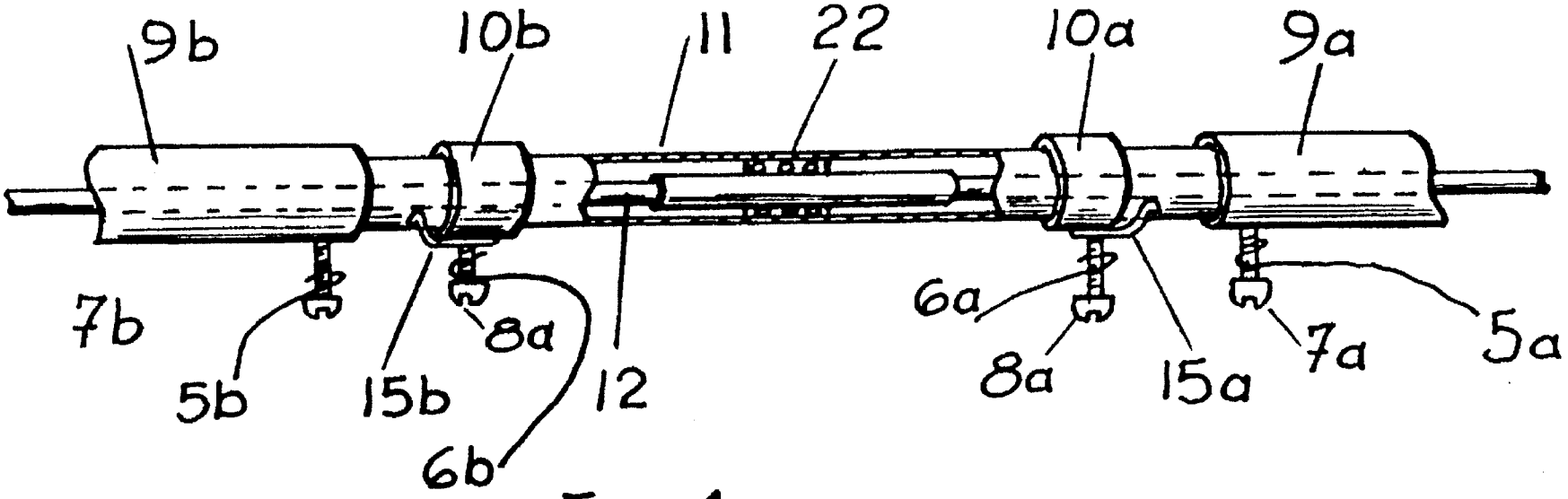
FIG. 4 shows a variable capacitor portion for use with two elements.

Tube 13 may be electrically isolated from tube 9 by nonconductor tube 11 having a ¾ inch inner diameter inside the length of boom 4. For an antenna with a short boom length, however, if nonconducting tube 11 is of sufficient strength and length, then it can take the place of boom 4, i.e., boom 4 is not required (as shown in FIG. 4). Tube 9 should be approximately 2 inches shorter than tube 13, or approximately 16 inches, to enable electrical contact to connecting wire 5. In a preferred embodiment, tubes 9 and 11 are stationary while tube 12 (and associated tube 13) is moveable. Advantageously, nonconductive tubes 11, 12 are constructed of lightweight plastic. The electrical isolation of conductive tubes 9, 13 by nonconductive tube 11 prevents high frequency voltage breakdown and arcing.

Capacitance is measured between electrically conductive connecting screws 7 and 8. Screws 7, 8 are electrically isolated from the boom 4 to prevent stray electrical coupling. Screw 7 makes an electrical connection between connecting wire 5 and conductive tube 9, and screw 8 makes an electrical connection between connecting wire 6 and conductive tube 13. Screw 7 directly connects electrically and mechanically to tubes 9 and 11. Screw 7 provides mechanical coupling between conductive tube 9 and nonconductive tube 11 to prevent movement of either tube 9 or tube 11 inside the boom 4.

Figure 3:
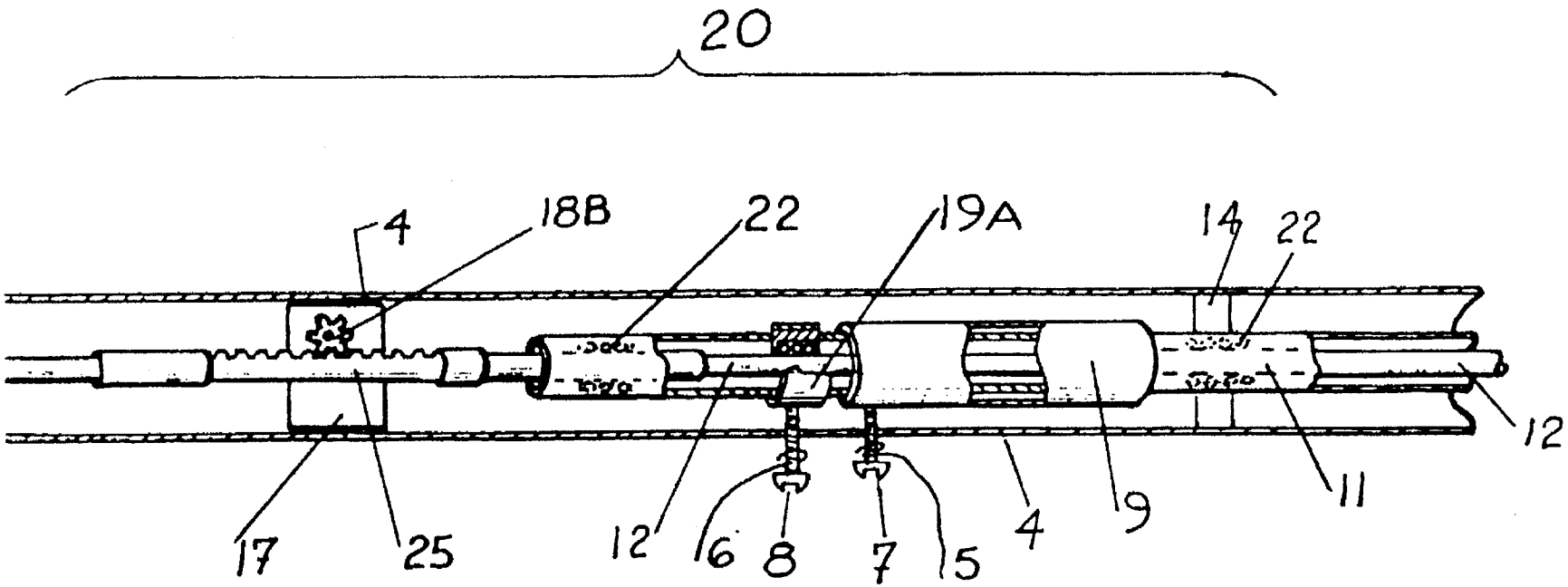
FIG. 3 shows a rack and pinion movement for the remote tuning portion of a variable capacitance antenna.

Screw 8 connects to conductive tube 13 through tube 10 and contact 15. Preferably, contact 15 is made using a flexible, insulated steel wire spring approximately ¼ inch wide and 0.010 inches thick in the shape of half a coil. A opening at 45° can be made in nonconducting tube 11 that allows insertion of contact 15 through tube 11 to electrically connect with tube 13. Additionally, screw 8 prevents movement between tube 10 and tube 11. Alternatively, the contact can be made of linear bearings 15A as shown in FIG. 3. Linear bearings provide multiple points of contact to conductive tube 13 and an increased voltage rating for the variable capacitor due to the air gap between tubes 13 and 9 in addition to nonconductive tube 11, however, linear bearings do not provide the desirable scrubbing action that wire contact 15 provides.

Antenna capacitance varies when conductive tube 13 moves relative to conductive tube 9 along the axis of the boom 4. Nonconductive tubes 11, 12 provide a "track" for the movement of conductive tube 13. Positioning the tubes so that stationary conductive tube 9 and moveable conductive tube 13 are maximally coupling (fully overlapping) provides, for example, a capacitance of approximately 100 picofarads. Moving tube 13 so that the conductive tubes 9, 13 are completely decoupled (nonoverlapping) produces zero capacitance and decouples the dipole element associated with the variable capacitor. FIG. 2 shows conductive tubes 9 and 13 completely decoupled. The exact amount of capacitance provided by this arrangement is determined by the surface area of conductive tubes 9, 13, the separation distance between the conductive tubes 9, 13, and the distance of the coupled length thereof. By varying the diameter of tube 9 along its length, capacitance change may be made nonlinear, which can be advantageous for multi-element antennas used for multifrequency purposes.

FIG. 2 represents capacitor portion 20 inside the boom which can be duplicated for each dipole element. Moving the inner conductive tubes along the axis of the boom relative to the outer conductive tubes provides a change of capacitance for each dipole element. This variable capacitance arrangement makes possible fine adjustments to the capacitance of the dipole elements. This change in capacitance varies the resonance frequency of the dipole elements and provides an antenna with high efficiency radiation transfer and gain with directivity. Additionally, the variable capacitor portion 20 enables the antenna to have a sharp frequency focus so that the antenna can receive weak signals on one frequency and reject strong signals on nearby frequencies.

The maximum coupling length of the conductive tubes of the capacitor portion in the reflector element 3 and director element 1 can be varied by +10% and −10%, respectively, compared to the maximum coupling length of the conductive tubes in the capacitor portion of driver element 2. Because the dipole elements are variably tunable, this variable capacitance antenna is capable of receiving and transmitting in more frequency bands with a higher gain for any particular frequency than previous antennas. Each dipole element can also be independently tunable by providing separate, shorter, nonconductive tubes for each dipole element (rather than a single long nonconductive tube 12 for all the dipole elements) as a track for each inner conductive tube 13.

In a preferred embodiment, controlling the movement of tube 13 is accomplished by using a reversible low-speed motor or step motor 17. Motor 17 may be connected near the center of capacitor portion 20 as shown in FIG. 2, or it may be connected near an end of capacitor portion 20 as shown in FIG. 3. As shown in FIG. 2, movement of tube 13 can be attained by winding a cord 19 secured to tube 12 in two places and wrapping the cord 19 around the motor shaft 18A of the motor 17. Tube 11 may be cut away at appropriate points to prevent tube 11 from impeding the movement of the cord 19. Since there is not much friction between tube 11 and tube 13, pulling forces (torque) on the cord 19 can be as low as 15 lbs/in for a 40 foot boom. Reversal of the direction of motor shaft 18A may be accomplished by reversing the electrical connection to the motor 17, which can be controlled remotely along with fine adjustments of the motor speed. Preferably, nonconductive spacers 14 prevent tubes 9, 11, 12, 13 of the capacitor portion 20 from bumping into the inner walls of the boom 4. Advantageously, tube 11 has a low friction interface such as linear bearings 22 on its inner diameter to reduce friction between tube 11 and tube 12 and prevent side thrust forces from slowing or stopping the motor.

High friction assemblies can use more positive methods of movement such as rack and pinion movement between motor 17 and tube 12 as shown in FIG. 3. Rack portion 25 may be attached to or integrated into nonconductive tube 12. The rack portion 25 interacts with pinion motor shaft 18B to provide force to move nonconductive tube 12 and associated conductive tube 13 along the axis of boom 4. Note that FIG. 3 shows conductive tube 13 partially coupled with conductive tube 9.

For a single element vertical antenna, motor 17 may be located at the bottom of the element to allow easy access and provide for nut and screw rotation methods or mobile antenna retraction drive systems to provide axial movement of tube 13 within the driven element.

Varying the capacitance of each dipole element, as opposed to having the same capacitance for each dipole element, will vary the footprint of radiation greatly. If each dipole element is of the same length, making the reflector element 3 (shown in FIG. 1) slightly more capacitive than the driver element 2 (shown in FIG. 1) and the director element 1 (shown in FIG. 1) slightly less capacitive than the driver element 2 produces maximum gain from the direction of the driver element 2 to the director element 1 as per a conventional Yagi antenna design. By varying dipole element lengths, the variable capacitance antenna can provide a reversal of maximum gain direction for some frequencies within the design of the antenna. For additional variability in directivity, the entire antenna structure may be rotatable about its horizontal axis for vertical polarization applications.

FIG. 4 shows a variable capacitor portion without a boom for use with two elements. In this embodiment, two outer conductive tubes *9a*, *9b* share one inner conductive tube 13. FIG. 4 shows the variable capacitor completely decoupled. However, moving conductive tube 13 toward the right will couple conductive tube *9a* and its associated dipole element through connecting wires *5a*, *6a*. Then, moving conductive tube 13 back toward the left will decouple conductive tube *9a* and its associated dipole element and couple conductive tube *9b* and its associated dipole element through connecting wires *5b*, *6b*. This feature is advantageous in that it allows tailoring of the spacing between coupled elements in a multi-element antenna. The spacing of the coupled elements are important in determining the gain, establishing the front to back ratio, and ensuring that element gains or phases are additive rather than subtractive.

This variable capacitance antenna may, of course, be carried out in specific ways other than those set forth here without departing from the spirit and essential characteristics of the invention. Therefore, the presented embodiments should be considered in all respects as illustrative and not restrictive and all modifications falling within the meaning and equivalency range of the appended claims are intended to be embraced therein.

We claim:

1. A variable capacitance antenna comprising:

a support boom for housing a variable capacitance;

a fixed distributed inductance of appreciable physical length with respect to the wavelength of operation;

a continuous, driven dipole element;

an outer fixed cylindrical conductive tube defining a first plate of said variable capacitance;

an inner linearly movable cylindrical conductive tube defining a second plate of said variable capacitance, and sliding relative to said outer tube for providing said variable capacitance;

said plates being connected to respective wires having ends;

said tubes insulated from each other by a fixed cylindrical non-conductive tube;

said distributed inductance characterized as a linear conductive means disposed along said driven dipole element; and said variable capacitance and distributed inductance electrically connected in parallel to define a tuneable parallel resonant circuit.

2. A variable capacitance antenna according to claim 1 further comprising:

at least two continuous dipole element mounted on said support boom; and wherein said variable capacitance comprises at least one variable capacitance positioned in said housing and electrically connected to said dipole element.

3. A variable capacitance antenna according to claim 1, wherein said variable capacitance comprises:

a first conductive surface electrically connected to said dipole element; and a second conductive surface located proximally to said first conductive surface and electrically connected to said dipole element.

4. A variable capacitance antenna according to claim 3, wherein said first conductive surface is a first conductive tube; and said second conductive surface is a second conductive tube arranged coaxially with said first conductive tube, and said second conductive tube diameter is greater than said first conductive tube diameter.

5. A variable capacitance antenna according to claim 4, wherein the diameter of at least one of said conductive tubes varies along its length.

6. A variable capacitance antenna according to claim 4 further comprising:

a sliding contact electrically connected to said first conductive tube, wherein said sliding contact is connected to said dipole element.

7. A variable capacitance antenna according to claim 6 further comprising:

a drive connected to said first conductive tube.

8. A variable capacitance antenna according to claim 7, wherein said drive is a reversible motor.

9. A variable capacitance antenna according to claim 7, further comprising:

a remotely located drive control.

* * * * *